US011633974B1

(12) United States Patent
Tosh

(10) Patent No.: US 11,633,974 B1
(45) Date of Patent: Apr. 25, 2023

(54) MODULAR BINDER ASSEMBLY

(71) Applicant: Vernon Tosh, Vancouver, WA (US)

(72) Inventor: Vernon Tosh, Vancouver, WA (US)

( * ) Notice: Subject to any disclaimer, the term of this patent is extended or adjusted under 35 U.S.C. 154(b) by 0 days.

(21) Appl. No.: 17/725,219

(22) Filed: Apr. 20, 2022

(51) Int. Cl.
*B42F 3/04* (2006.01)
*B42F 7/04* (2006.01)
*B42F 13/16* (2006.01)

(52) U.S. Cl.
CPC ..... *B42F 13/16* (2013.01); *B42F 3/04* (2013.01); *B42F 7/04* (2013.01); *B42P 2241/02* (2013.01); *B42P 2241/06* (2013.01)

(58) Field of Classification Search
CPC ..... B42F 3/04; B42F 7/04
See application file for complete search history.

(56) References Cited

U.S. PATENT DOCUMENTS

| | | | | |
|---|---|---|---|---|
| 4,681,474 | A | 7/1987 | Wiberg | |
| 5,190,127 | A * | 3/1993 | Cummings | B42F 13/40 190/102 |
| 5,489,021 | A * | 2/1996 | Wallingford | B42F 13/40 206/214 |
| 6,000,873 | A | 12/1999 | Burton | |
| 7,055,682 | B1 * | 6/2006 | Domotor | A45C 13/02 206/214 |
| D529,957 | S | 10/2006 | Shimada | |
| 7,281,877 | B1 * | 10/2007 | Lederer | A45C 13/02 281/31 |
| D561,826 | S | 2/2008 | Lynen | |
| 7,637,682 | B2 | 12/2009 | To | |
| D611,533 | S | 3/2010 | Baker | |
| 2005/0139558 | A1 * | 6/2005 | Kephart | A47G 29/08 211/DIG. 1 |
| 2006/0008320 | A1 * | 1/2006 | Spaulding | B42F 13/00 402/79 |
| 2007/0274769 | A1 | 11/2007 | Shimada | |
| 2007/0297849 | A1 | 12/2007 | Merzon | |
| 2021/0086547 | A1 * | 3/2021 | Johnson | A45C 13/023 |

FOREIGN PATENT DOCUMENTS

| | | | | |
|---|---|---|---|---|
| DE | 20115525 U1 * | 12/2001 | | A45C 1/024 |
| KR | 200310357 Y1 * | 4/2003 | | |

OTHER PUBLICATIONS

DE-20115525-U1 English Translation (Year: 2002).*

* cited by examiner

*Primary Examiner* — Kyle R Grabowski

(57) ABSTRACT

A modular binder assembly for storing a variety of objects includes a binder which includes a first portion that is hingedly attached to a second portion. A plurality of first mating members is each coupled to a respective one of the first portion and the second portion of the binder. A document folder is removably attachable to respective ones of the first mating members for insertably receiving documents. A cassette caddy is removably attachable to respective ones of the first mating members. A personal electronic device is removably attachable to a respective one of the first mating members on the binder thereby facilitating the personal electronic device to be positioned at a variety of locations on the binder.

11 Claims, 2 Drawing Sheets

MODULAR BINDER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to binder devices and more particularly pertains to a new binder device for storing a variety of objects in a variety of orientations. The device includes a binder and plurality of mating members that are distributed across the binder. The device includes a document folder, a cassette caddy, a personal electronic device and a ring binder that are each is attachable to a respective mating member to facilitate the document folder, the cassette caddy, the personal electronic device and the ring binder to each be positioned at a variety of locations in the binder. Furthermore, the document folder, the cassette caddy, the personal electronic device and the ring binder can be attached to the binder independently or in any conceivable combination.

(2) Description of Related Art Including Information Disclosed Under 37 CFR 1.97 and 1.98

The prior art relates to binder devices including folder device that includes a ring binder that is removably attachable to the folder. The prior art discloses a modular binder device that includes a folder, a panel that is removably attachable to the folder and a ring binder that is removably attachable to the folder. The prior art discloses a variety of mechanical ring binders for engaging sheets of paper. The prior art discloses a binder device that includes a portfolio that is releasably attachable to the binder device.

BRIEF SUMMARY OF THE INVENTION

An embodiment of the disclosure meets the needs presented above by generally comprising a binder which includes a first portion hingedly attached to a second portion.

A plurality of first mating members is each coupled to a respective one of the first portion and the second portion of the binder. A document folder is removably attachable to respective ones of the first mating members for insertably receiving documents. A cassette caddy is removably attachable to respective ones of the first mating members. A personal electronic device is removably attachable to a respective one of the first mating members on the binder thereby facilitating the personal electronic device to be positioned at a variety of locations on the binder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
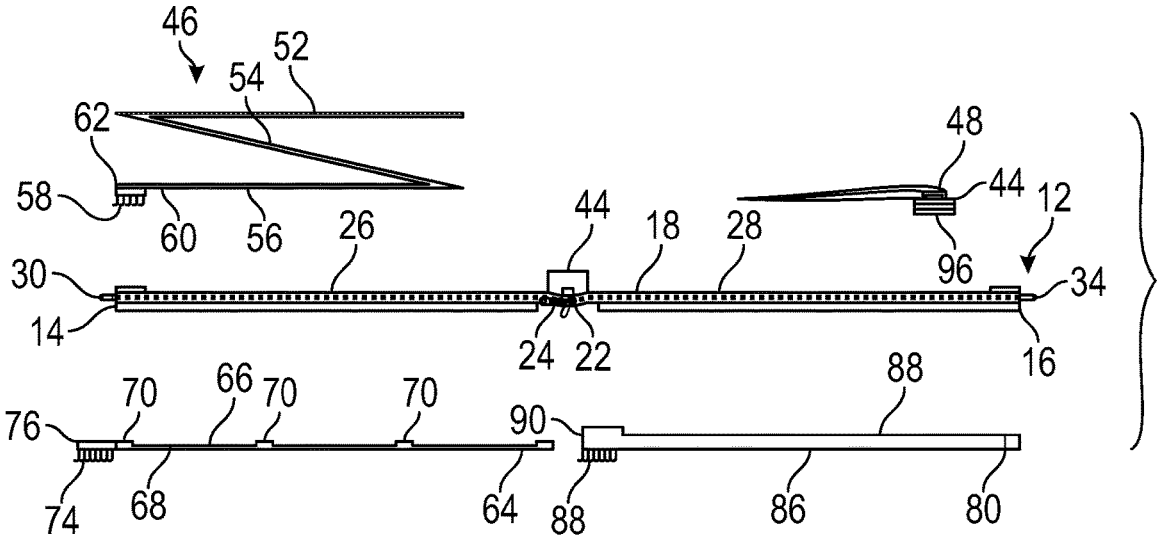
FIG. 1 is a front view of an embodiment of the disclosure.
Figure 2:
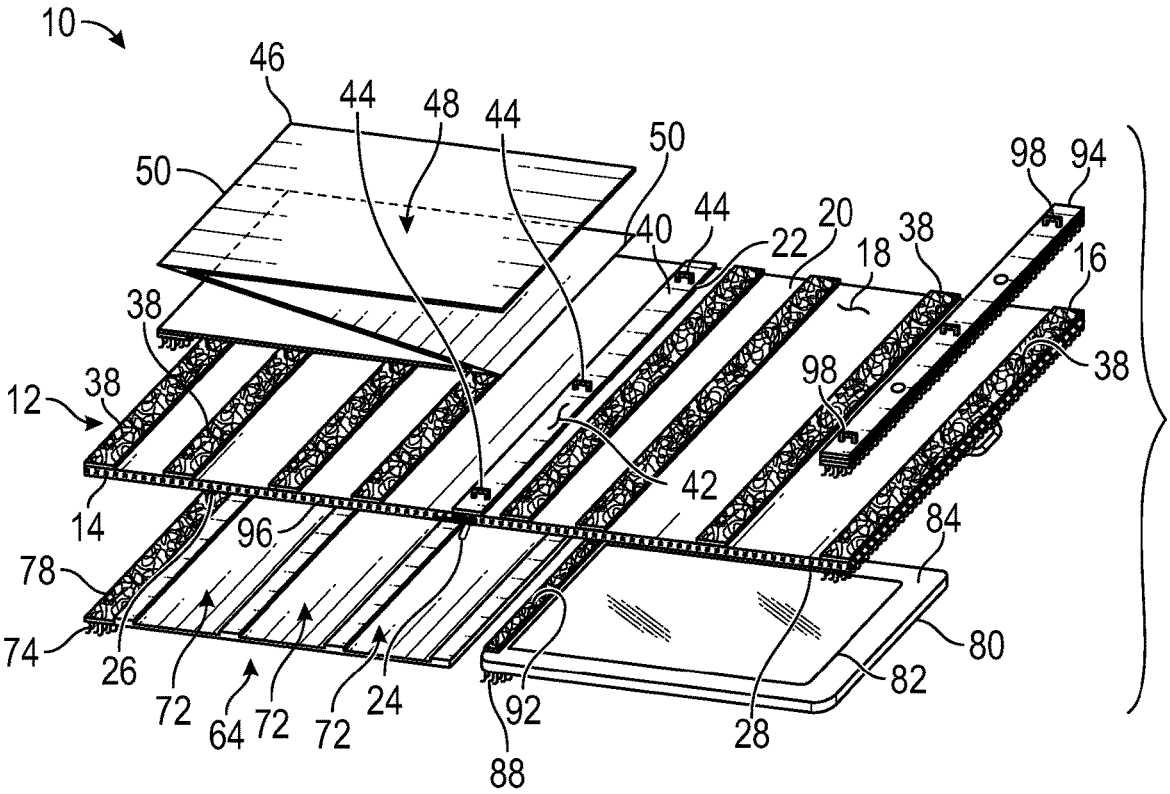
FIG. 2 is a perspective view of a modular binder assembly according to an embodiment of the disclosure.
Figure 3:
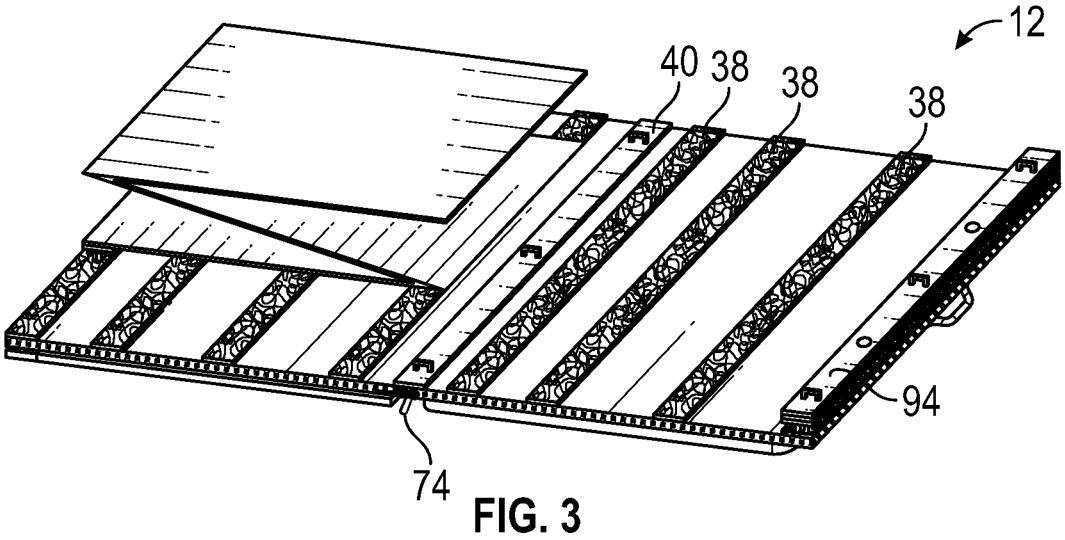
FIG. 3 is a top perspective view of an embodiment of the disclosure showing a document folder and a second panel each attached to a binder.
Figure 4:
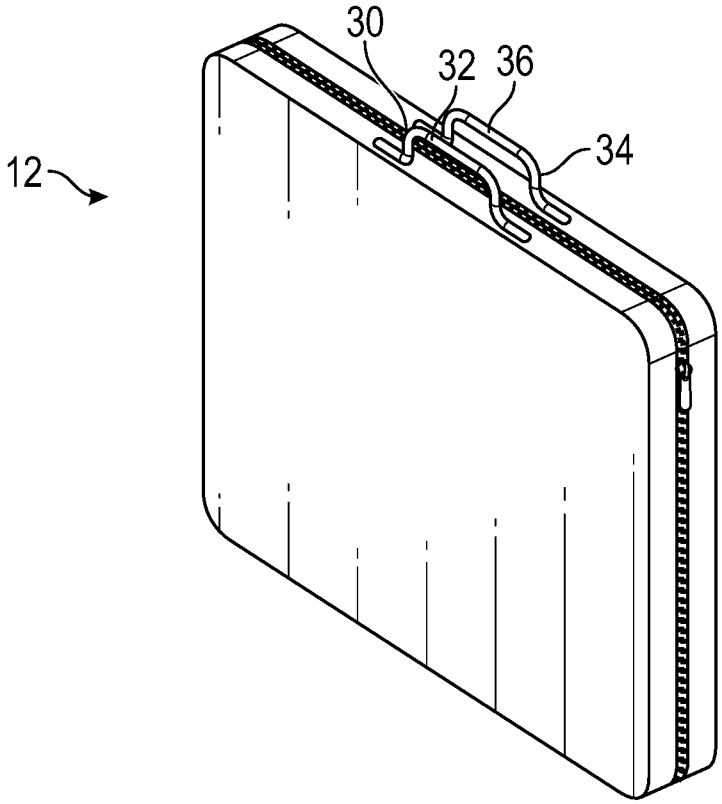
FIG. 4 is a perspective view of an embodiment of the disclosure showing a binder in a closed position.

With reference now to the drawings, and in particular to FIGS. 1 through 4 thereof, a new binder device embodying the principles and concepts of an embodiment of the disclosure and generally designated by the reference numeral 10 will be described.

As best illustrated in FIGS. 1 through 4, the modular binder assembly 10 generally comprises a binder 12 which includes a first portion 14 that is hingedly attached to a second portion 16. The binder 12 is positionable in an open position having each of the first portion 14 and the second portion 16 lying on a common plane, and the binder 12 is positionable in a closed position having the first portion 14 lying on the second portion 16. Each of the first portion 14 and the second portion 16 has an upwardly facing surface 18 and a perimeter edge 20, and the perimeter edge 20 of each of the first portion 14 and the second portion 16 has a first lateral side 22. The first lateral side 22 of the perimeter edge 20 of the first portion 14 is hingedly attached to the first lateral side 22 of the perimeter edge 20 of the second portion 16. Furthermore, the upwardly facing surface 18 of each of the first portion 14 and the second portion 16 is oriented coplanar with each other when the binder 12 is in the open position, and the upwardly facing surface 18 of the first portion 14 is directed toward the upwardly facing surface 18 of the second portion 16 when the binder 12 is in the closed position.

A coupler 24 is attached to the binder 12 and the coupler 24 comprises a primary portion 26 which extends around the first portion 14 of the binder 12, and the coupler 24 comprises a secondary portion 28 extending around the second portion 16 of the binder 12. The primary portion 26 is matable to the secondary portion 28 when the binder 12 is in the closed position for retaining the binder 12 in the closed position. The primary portion 26 extends around the perimeter edge 20 of the first portion 14 except for the first lateral side 22 of the perimeter edge 20 of the first portion 14. Additionally, the secondary portion 28 extends around the perimeter edge 20 of the second portion 16 except for the first lateral side 22 of the perimeter edge 20 of the second portion 16. The coupler 24 may comprise a zipper or other type of mechanical, releasable fastener.

A first handle 30 is coupled to the first portion 14 of the binder 12 and the first handle 30 is positioned on an opposing side of the perimeter edge 20 of the first portion 14 with respect to the first lateral side 22 of the perimeter edge 20 of the first portion 14. Additionally, the first handle 30 has a member 32 that is spaced from the perimeter edge 20 of the first portion 14 thereby facilitating the member 32 to be gripped. A second handle 34 is coupled to the second portion 16 of the binder 12 and the second handle 34 is positioned on an opposing side of the perimeter edge 20 of the second portion 16 with respect to the first lateral side 22 of the perimeter edge 20 of the second portion 16. The second handle 34 has a member 36 that is spaced from the perimeter edge 20 of the second portion 16 thereby facilitating the member 36 of the second handle 34 to be gripped, and the second handle 34 is aligned with the first handle 30 when the binder 12 is in the closed position.

A plurality of first mating members 38 is each coupled to a respective one of the first portion 14 and the second portion 16 of the binder 12, and the first mating members 38 are distributed across the binder 12. The first mating members 38 associated with the first portion 14 are positioned on the upwardly facing surface 18 of the first portion 14, and each of the first mating members 38 associated with the first portion 14 is oriented to extend along a line is oriented parallel with the first lateral side 22 of the perimeter edge 20 of the first portion 14. Each of the first mating members 38 associated with the second portion 16 is positioned on the upwardly facing surface 18 of the second portion 16, and each of the first mating members 38 associated with the second portion 16 is oriented to extend along a line is oriented parallel with the first lateral side 22 of the perimeter edge 20 of the second portion 16. Each of the first mating members 38 on the binder 12 may comprise a loop portion of a hook and loop fastener or other type of multiple use, releasable fastener.

A first panel 40 is attached to the binder 12, the first panel 40 extends along a full width of the binder 12 and the first panel 40 is centrally positioned on the binder 12. The first panel 40 is aligned with an intersection between the first lateral side 22 of the perimeter edge 20 of the first portion 14 and the first lateral side 22 of the perimeter edge 20 of the second portion 16. The first panel 40 extends along a full length of the first lateral side 22 of the perimeter edge 20 of each of the first portion 14 and the second portion 16 and the first panel 40 has an exposed surface 42. Furthermore, the first panel 40 has a plurality of ring binders 44 that is each movably integrated into the first panel 40 to engage holes in sheets of paper. The ring binders 44 are spaced apart from each other and are distributed along a full length of the exposed surface 42 of the first panel 40.

A document folder 46 is provided that is removably attachable to respective ones of the first mating members 38 thereby facilitating the document folder 46 to be positioned at a variety of locations in the binder 12. The document folder 46 has a plurality of storage compartments 48 for insertably receiving documents. Furthermore, the document folder 46 has a series of folds 50 to define a first section 52, second section 54 and a third section 56 of the document folder 46. A second mating member 58 is coupled to a lower facing surface 60 of the first section 52 of the document folder 46 and the second mating member 58 is aligned with an outward edge 62 of the first section 52 of the document folder 46. Additionally, the second mating member 58 releasably engages a respective one of the first mating members 38 on the binder 12. The second mating member 58 may comprise a hook portion of a hook and loop fastener of other type of multiple use, releasable fastener.

A cassette caddy 64 is removably attachable to respective ones of the first mating members 38 thereby facilitating the cassette caddy 64 to be positioned at a variety of locations in the binder 12. The cassette caddy 64 has a top side 66 and a bottom side 68, and the cassette caddy 64 has a plurality of ridges 70 that each extends upwardly from the top side 66. The ridges 70 are spaced apart from each other and are distributed along the cassette caddy 64 to define a plurality of storage spaces 72 between each of the ridges 70. Moreover, each of the storage spaces 72 can insertably receive a cassette tape or other object of similar dimensions to a cassette tape.

A second mating member 74 is coupled to the bottom side 68 of the cassette caddy 64 and the second mating member 74 on the bottom side 68 of the cassette caddy 64 is aligned with an outer edge 76 of the cassette caddy 64. Additionally, the second mating member 74 on the bottom side 68 of the cassette caddy 64 releasably engages a respective one of the first mating members 38 on the binder 12. The second mating member 74 on the bottom side 68 of the cassette caddy 64 may comprise a hook portion of a hook and loop fastener or other type of multiple use, releasable fastener. A third mating member 78 is coupled to the top side 66 of the cassette caddy 64 and the third mating member 78 is aligned with the second mating member 74 on the bottom side 68 of the cassette caddy 64. The third mating member 78 may comprise a loop portion of a hook and loop fastener or other type of multiple use, releasable fastener.

A personal electronic device 80 is included which has a display 82 that is integrated into the personal electronic device 80. The personal electronic device 80 is removably attachable to a respective one of the first mating members 38 on the binder 12 thereby facilitating the personal electronic device 80 to be positioned at a variety of locations on the binder 12. The personal electronic device 80 has an upper side 84 and a lower side 86, and the personal electronic device 80 may comprise an electronic tablet, a smart phone or any other type of personal electronic device that has an electronic display and wireless communication capabilities.

A second mating member 88 is coupled to the lower side 86 of the personal electronic device 80 and the second mating member 88 on the lower side 86 of the personal electronic device 80 is aligned with an outer edge 90 of the personal electronic device 80. The second mating member 88 on the lower side 86 of the personal electronic device 80 releasably engages a respective one of the first mating members 38 on the binder 12. Furthermore, the second mating member 88 on the lower side 86 of the personal electronic device 80 may comprise a hook portion of a hook and loop fastener or other type of multiple use, releasable fastener. A third mating member 92 is coupled to the upper side 84 of the personal electronic device 80 and the third mating member 92 on the upper side 84 of the personal electronic device 80 is aligned with the second mating member 88 on the lower side 86 of the personal electronic device 80. The third mating member 92 on the upper side 84 of the personal electronic device 80 may comprise a hook portion of a hook and loop fastener or other type of multiple use, releasable fastener.

A second panel 94 is removably attachable to a respective one of the first mating members 38 on the binder 12 and the second panel 94 has a bottom surface 96 and a top surface 98. The second panel 94 has a plurality of ring binders 98 that is each integrated into the top surface 98 of the second panel 94 to engage holes in sheets of paper. The ring binders 98 on the top surface 98 of the ring binder 12 are spaced apart from each other and are distributed along the top surface 98. A second mating member 100 is coupled to the bottom surface 96 of the second panel 94 and the second mating member 100 on the bottom surface 96 extends along a full length of the second panel 94. The second mating member 100 on the bottom surface 96 of the second panel 94 releasably engages a respective one of the first mating members 38 on the binder 12. Furthermore, the second mating member 100 on the bottom surface 96 of the second panel 94 may comprise a hook portion of a hook and loop fastener or other type of multiple use, releasable fastener.

In use, the binder 12 is employed in the conventional tradition of binders with respect to storing and carrying documents and other items commonly associated with binders. The document folder 46, the cassette caddy 64, the personal electronic device 80 and the second panel 94 can each be attached to the binder 12, either independently or in any conceivable combination. Furthermore, each of the document folder 46, the cassette caddy 64, the personal electronic device 80 and the second panel 94 can be positioned at any desired location in the binder 12. In this way the binder 12 facilitates a variety of configurations of storage options to satisfy the needs of nearly any user. Thus, the binder 12 can perform a variety of storage tasks which can be customized or changed at any time, depending upon the duties to be performed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular binder assembly for facilitating a variety of objects to be stored and transported, said assembly comprising:

a binder comprising a first portion being hingedly attached to a second portion, said binder being positionable in an open position having each of said first portion and said second portion lying on a common plane, said binder being positionable in a closed position having said first portion lying on said second portion;

a coupler being attached to said binder, said coupler comprising a primary portion extending around said first portion of said binder, said coupler comprising a secondary portion extending around said second portion of said binder, said primary portion being matable to said secondary portion when said binder is in said closed position for retaining said binder in said closed position;

a plurality of first mating members, each of said first mating members being coupled to a respective one of said first portion and said second portion of said binder, said first mating members being distributed across said binder;

a first panel being attached to said binder, said first panel extending along a full width of said binder, said first panel being centrally positioned on said binder, said first panel having a plurality of ring binders each being movably integrated into said first panel wherein each of said ring binders is configured to engage holes in sheets of paper;

a document folder being removably attachable to respective ones of said first mating members thereby facilitating said document folder to be positioned at a variety of locations in said binder;

a caddy being removably attachable to respective ones of said first mating members thereby facilitating said caddy to be positioned at a variety of locations in said binder;

a personal electronic device having a display being integrated into said personal electronic device, said personal electronic device being removably attachable to a respective one of said first mating members on said binder thereby facilitating said personal electronic device to be positioned at a variety of locations on said binder;

wherein said caddy has a top side and a bottom side, said caddy having a plurality of ridges each extending upwardly from said top side, said ridges being spaced apart from each other and being distributed along said caddy to define a plurality of storage spaces between each of said ridges;

wherein said assembly includes a second mating member being coupled to said bottom side of said caddy, said second mating member on said bottom side of said caddy being aligned with an outer edge of said caddy, said second mating member on said bottom side of said caddy releasably engaging a respective one of said first mating members on said binder; and wherein said assembly includes a third mating member being coupled to said top side of said caddy, said third mating member being aligned with said second mating member on said bottom side of said caddy.

2. The assembly according to claim 1, wherein each of said first portion and said second portion has an upwardly facing surface and a perimeter edge, said perimeter edge of each of said first portion and said second portion having a first lateral side, said first lateral side of said perimeter edge of said first portion being hingedly attached to said first lateral side of said perimeter edge of said second portion, said upwardly facing surface of each of said first portion and said second portion being oriented coplanar with each other when said binder is in said open position, said upwardly facing surface of said first portion being directed toward said upwardly facing surface of said second portion when said binder is in said closed position.

3. The assembly according to claim 2, wherein said primary portion of said coupler extends around said perimeter edge of said first portion except for said first lateral side of said perimeter edge of said first portion, said secondary portion of said coupler extending around said perimeter edge of said second portion except for said first lateral side of said perimeter edge of said second portion.

4. The assembly according to claim 2, further comprising a first handle being coupled to said first portion of said binder, said first handle being positioned on an opposing side of said perimeter edge of said first portion with respect to said first lateral side of said perimeter edge of said first portion, said first handle having a member being spaced from said perimeter edge of said first portion thereby facilitating said member to be gripped.

5. The assembly according to claim 4, further comprising a second handle being coupled to said second portion of said binder, said second handle being positioned on an opposing side of said perimeter edge of said second portion with respect to said first lateral side of said perimeter edge of said second portion, said second handle having a member being spaced from said perimeter edge of said second portion thereby, facilitating said member of said second handle to be gripped, said second handle being aligned with said first handle when said binder is in said closed position.

6. The assembly according to claim 2, wherein:

said first mating members associated with said first portion are positioned on said upwardly facing surface of said first portion, each of said first mating members associated with said first portion being oriented to extend along a line being oriented parallel with said first lateral side of said perimeter edge of said first portion; and each of said first mating members associated with said second portion is positioned on said upwardly facing surface of said second portion, each of said first mating members associated with said second portion being oriented to extend along a line being oriented parallel with said first lateral side of said perimeter edge of said second portion.

7. The assembly according to claim 2, wherein said first panel is aligned with an intersection between said first lateral side of said perimeter edge of said first portion and said first lateral side of said perimeter edge of said second portion, said first panel extending along a full length of said first lateral side of said perimeter edge of each of said first portion and said second portion, said first panel having an exposed surface, said ring binders on said first panel being spaced apart from each other and being distributed along a full length of said exposed surface of said first panel.

8. The assembly according to claim 1, wherein:

said document folder has a series of folds to define a first section, second section and a third section of said document folder; and said assembly includes a second mating member being coupled to a lower facing surface of said first section of said document folder, said second mating member being aligned with an outward edge of said first section of said document folder, said second mating member releasably engaging a respective one of said first mating members on said binder.

9. The assembly according to claim 1, wherein:

said personal electronic device has an upper side and a lower side;

said assembly includes a second mating member being coupled to said lower side of said personal electronic device, said second mating member on said tower side of said personal electronic device being aligned with an outer edge of said personal electronic device, said second mating member on said lower side of said personal electronic device being releasably engaging a respective one of said first mating members on said binder; and said assembly includes a third mating member being coupled to said upper side of said personal electronic device, said third mating member on said upper side of said personal electronic device being aligned with said second mating member on said lower side of said personal electronic device.

10. The assembly according to claim 1, further comprising:

a second panel being removably attachable to a respective one of said first mating members on said binder, said second panel having a bottom surface and a top surface, said second panel having a plurality of ring binders each being integrated into said top surface of said second panel wherein each of said ring binders on said top surface of said second panel is configured to engage holes in sheets of paper, said ring binders on said top surface of said ring binder being spaced apart from each other and being distributed along said top surface; and a second mating member being coupled to said bottom surface of said second panel, said second mating member extending along a full length of said second panel, said second mating member on said bottom surface of said second panel releasably engaging a respective one of said first mating members on said binder.

11. A modular binder assembly for facilitating a variety of objects to be stored and transported, said assembly comprising:

a binder comprising a first portion being hingedly attached to a second portion, said binder being positionable in an open position having each of said first portion and said second portion lying on a common plane, said binder being positionable in a closed position having said first portion lying on said second portion, each of said first portion and said second portion having an upwardly facing surface and a perimeter edge, said perimeter edge of each of said first portion and said second portion having a first lateral side, said first lateral side of said perimeter edge of said first portion being hingedly attached to said first lateral side of said perimeter edge of said second portion, said upwardly facing surface of each of said first portion and said second portion being oriented coplanar with each other when said binder is in said open position, said upwardly facing surface of said first portion being directed toward said upwardly facing surface of said second portion when said binder is in said closed position;

a coupler being attached to said binder, said coupler comprising a primary portion extending around said first portion of said binder, said coupler comprising a secondary portion extending around said second portion of said binder, said primary portion being matable to said secondary portion when said binder is in said closed position for retaining said binder in said closed position, said primary portion extending around said perimeter edge of said first portion except for said first lateral side of said perimeter edge of said first portion, said secondary portion extending around said perimeter edge of said second portion except for said first lateral side of said perimeter edge of said second portion;

a first handle being coupled to said first portion of said binder, said first handle being positioned on an opposing side of said perimeter edge of said first portion with respect to said first lateral side of said perimeter edge of said first portion, said first handle having a member being spaced from said perimeter edge of said first portion thereby facilitating said member to be gripped;

a second handle being coupled to said second portion of said binder, said second handle being positioned on an opposing side of said perimeter edge of said second portion with respect to said first lateral side of said perimeter edge of said second portion, said second handle having a member being spaced from said perimeter edge of said second portion thereby facilitating said member of said second handle to be gripped, said second handle being aligned with said first handle when said binder is in said closed position;

a plurality of first mating members, each of said first mating members being coupled to a respective one of said first portion and said second portion of said binder, said first mating members being distributed across said binder, said first mating members associated with said first portion being positioned on said upwardly facing surface of said first portion, each of said first mating members associated with said first portion being oriented to extend along a line being oriented parallel with said first lateral side of said perimeter edge of said first portion, each of said first mating members associated with said second portion being positioned on said upwardly facing surface of said second portion, each of said first mating members associated with said second portion being oriented to extend along a line being oriented parallel with said first lateral side of said perimeter edge of said second portion;

a first panel being attached to said binder, said first panel extending along a full width of said binder, said first panel being centrally positioned on said binder, said first panel being aligned with an intersection between said first lateral side of said perimeter edge of said first portion and said first lateral side of said perimeter edge of said second portion, said first panel extending along a full length of said first lateral side of said perimeter edge of each of said first portion and said second portion, said first panel having an exposed surface, said first panel having a plurality of ring binders each being movably integrated into said first panel wherein each of said ring binders is configured to engage holes in sheets of paper, said ring binders being spaced apart from each other and being distributed along a full length of said exposed surface of said first panel;

a document folder being removably attachable to respective ones of said first mating members thereby facilitating said document folder to be positioned at a variety of locations in said binder, said document folder having a series of folds to define a first section, second section and a third section of said document folder;

a second mating member being coupled to a lower facing surface of said first section of said document folder, said second mating member being aligned with an outward edge of said first section of said document folder, said second mating member releasably engaging a respective one of said first mating members on said binder;

a caddy being removably attachable to respective ones of said first mating members thereby facilitating said caddy to be positioned at a variety of locations in said binder, said caddy having a top side and a bottom side, said caddy having a plurality of ridges each extending upwardly from said top side, said ridges being spaced apart from each other and being distributed along said caddy to define a plurality of storage spaces between each of said ridges;

a second mating member being coupled to said bottom side of said caddy, said second mating member on said bottom side of said caddy being aligned with an outer edge of said caddy, said second mating member on said bottom side of said cassette caddy releasably engaging a respective one of said first mating members on said binder;

a third mating member being coupled to said top side of said caddy, said third mating member being aligned with said second mating member on said bottom side of said caddy;

a personal electronic device having a display being integrated into said personal electronic device, said personal electronic device being removably attachable to a respective one of said first mating members on said binder thereby facilitating said personal electronic device to be positioned at a variety of locations on said binder, said personal electronic device having an upper side and a lower side;

a second mating member being coupled to said lower side of said personal electronic device, said second mating member on said lower side of said personal electronic device being aligned with an outer edge of said personal electronic device, said second mating member on said lower side of said personal electronic device being releasably engaging a respective one of said first mating members on said binder;

a third mating member being coupled to said upper side of said personal electronic device, said third mating member on said upper side of said personal electronic device being aligned with said second mating member on said lower side of said personal electronic device;

a second panel being removably attachable to a respective one of said first mating members on said binder, said second panel having a bottom surface and a top surface, said second panel having a plurality of ring binders each being integrated into said top surface of said second panel wherein each of said ring binders on said top surface of said second panel is configured to engage holes in sheets of paper, said ring binders on said top surface of said ring binder being spaced apart from each other and being distributed along said top surface; and a second mating member being coupled to said bottom surface of said second panel, said second mating member extending along a full length of said second panel, said second mating member on said bottom surface of said second panel releasably engaging a respective one of said first mating members on said binder.

* * * * *